US006286692B1

(12) United States Patent
Hemping

(10) Patent No.: US 6,286,692 B1
(45) Date of Patent: Sep. 11, 2001

(54) METHOD AND APPARATUS FOR MOUNTING DOOR DISPLAY

(75) Inventor: Kelly Hemping, Des Moines, IA (US)

(73) Assignee: EMCO Enterprises, Inc., Des Moines, IA (US)

( * ) Notice: Subject to any disclaimer, the term of this patent is extended or adjusted under 35 U.S.C. 154(b) by 0 days.

(21) Appl. No.: 09/620,096

(22) Filed: Jul. 20, 2000

(51) Int. Cl.[7] ..... A47F 7/00
(52) U.S. Cl. ..... 211/169; 211/96; 206/325
(58) Field of Search ..... 211/48, 96, 168, 211/169, 169.1; 206/325

(56) References Cited

U.S. PATENT DOCUMENTS

D. 417,978 * 12/1999 Reed ..... D6/468
2,194,238 * 3/1940 Weaver .
2,584,255 * 2/1952 Brown .
3,391,796 * 7/1968 Cross .
3,664,514 * 5/1972 Drake ..... 211/169
3,777,896 * 12/1973 Ehrlich ..... 211/169 X
4,270,290 * 6/1981 Eckert ..... 211/169 X
4,428,096 * 1/1984 Kaspar .
4,884,687 * 12/1989 Stever ..... 206/325 X
5,503,278 4/1996 Ishmael ..... 211/169

* cited by examiner

*Primary Examiner*—Robert W. Gibson, Jr.
(74) *Attorney, Agent, or Firm*—Zarley, McKee, Thomte, Voorhees & Sease

(57) ABSTRACT

A mounting system includes either a double wing bracket or a single wing bracket. A double wing bracket includes a U-shaped member adapted to embrace the opposite sides of a vertical pallet rack frame member. A plate is attached to the U-shaped member and includes holes for mounting hinge members. The hinge members are used to mount a door display frame for pivotal movement about a door display frame axis. A door frame and a door are mounted within the door display frame.

9 Claims, 6 Drawing Sheets

METHOD AND APPARATUS FOR MOUNTING DOOR DISPLAY

BACKGROUND OF THE INVENTION

This invention relates to a method and apparatus for mounting a door display.

The marketing of doors to the do-it-yourself home improver, or to contractors and professional carpenters, requires a door display device which can make the door readily accessible for inspection by the customer. Such door display devices must be capable of quick and simple construction at the point of sale, and must be capable of displaying the door in a functional condition so that the customer can operate the door and see how the door appears in an installation. The display device must be constructed in such a manner that it permits the display of numerous doors by utilizing a minimum of floor space at the point of sale.

U.S. Pat. No. 5,503,278 shows such a door display device. However, a suitable bracket system must be provided so as to permit the display to be mounted directly to the vertical members of pallet racks commonly utilized in home improvement stores. The bracket system must be sufficiently flexible to permit adjustment of the height of the brackets to accommodate the vertical members of the pallet assembly. Also, it is desirable to be able to mount two doors to a pair of brackets at the same time maintaining a strong rigid connection to the vertical pallet member so as to adequately support the weight of the door displays.

Therefore, a primary object of the present invention is the provision of an improved method and apparatus for mounting a door display.

A further object of the present invention is the provision of an improved apparatus for mounting a door display which permits the door display to be quickly and easily assembled and disassembled at the point of sale.

A further object of the present invention is the provision of an improved method and apparatus for mounting a door display which permits a plurality of doors to be displayed in side to side relation while at the same time occupying a minimum of floor space.

A further object of the present invention is the provision of an improved method and apparatus for mounting a door display which provides rigid strong attachment to the vertical member of a pallet rack commonly used in home improvement stores.

A further object of the present invention is the provision of an improved method and apparatus for mounting door displays which is flexible in accomodating various heights of the holes which appear in the vertical members of the pallet racks.

A further object of the present invention is the provision of an improved door display device which is economical to manufacture, durable in use, and efficient in operation.

The foregoing objects may be achieved by a door display adapted to be mounted to a vertical support member. The display includes a display frame comprising a pair of spaced apart side display frame members, a top display frame member, and a bottom display frame member forming a display opening. A door assembly is detachably mounted within the display opening, and a door is provided within the door frame. A door hinge pivotally mounts the door to the door frame for swinging movement about a door axis.

Upper and lower mounting brackets are provided and each comprise a first plate and a U-shaped plate. The first plate has a front face and a rear face and the U-shaped plate has a pair of spaced apart legs joined by a central web. The central web is attached to the rear face of the first plate. The spaced apart legs are shaped to embrace the opposite side faces of the vertical support member.

Upper and lower hinge members are attached to the front face of the first plate of the upper and lower mounting brackets respectively. The upper and lower hinge members pivotally connect the display frame to the upper and lower mounting brackets respectively for permitting the display frame to swing about a display axis with respect to the upper and lower mounting brackets.

The method of the present invention comprises taking an upper and a lower bracket, each of which comprise a first plate having a front plate face and a rear plate face and a U-shaped plate having a pair of legs joined by a web member. The web member is attached to the rear face of the first plate. The spaced apart legs are fitted around the vertical support member so as to embrace the vertical support member therebetween. They are then attached to the vertical support member so as to place the upper and lower brackets in spaced vertical relation to one another. Upper and lower hinge members are then attached to the front plate faces of the upper and lower brackets respectively. A door display frame is connected to the upper and lower hinge members for pivotal movement about a door display axis. A door frame is mounted within the door display frame and the door frame includes a door mounted therein for swinging movement about a door axis.

DETAILED DESCRIPTION OF THE PREFERRED EMBODIMENT

Figure 1:
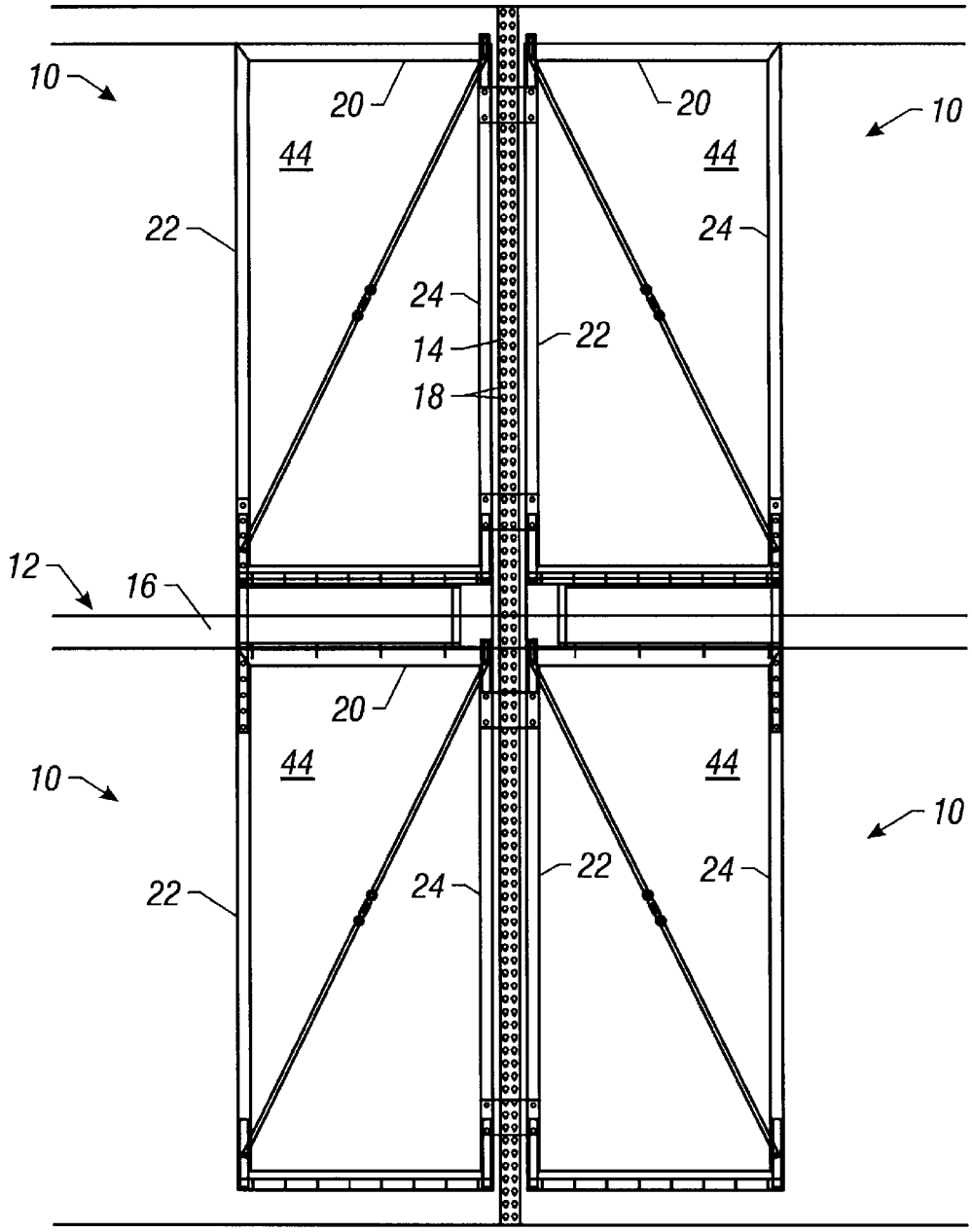
FIG. 1 is a front elevational view of a pallet pack having two upper door displays and two lower door displays mounted thereon.
Figure 2:
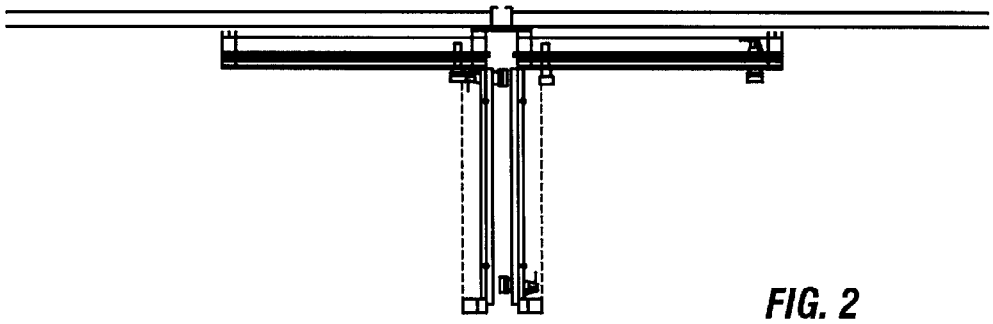
FIG. 2 is a top plan view of the device shown in FIG. 1.
Figure 5:
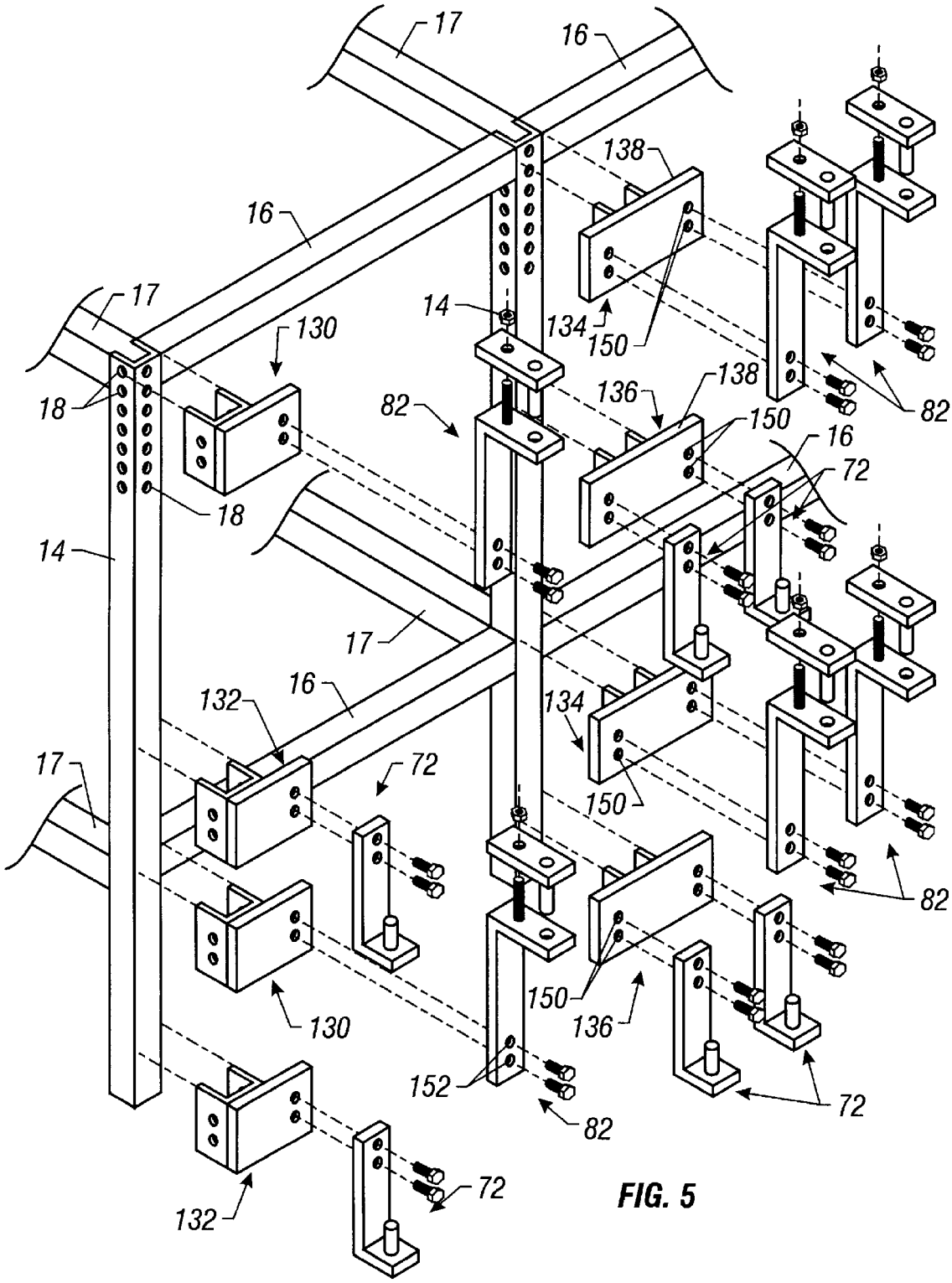
FIG. 5 is a perspective view of the pallet rack showing the mounting brackets in exploded view.

Referring to FIG. 1, four door displays are shown and are designated by the numeral 10. Door displays 10 are mounted to a pallet pack 12 comprising a plurality of vertical members 14 and horizontal members 16 and rearwardly extending horizontal members 17 (FIG. 5). The vertical members 4 include a plurality of spaced holes 18 on each of their opposite side faces as well as on its front face. Shelves are often supported on the rearwardly extending members 17 so as to provide storage areas for inventory in the home improvement store where these pallets racks are used.

Figure 8:
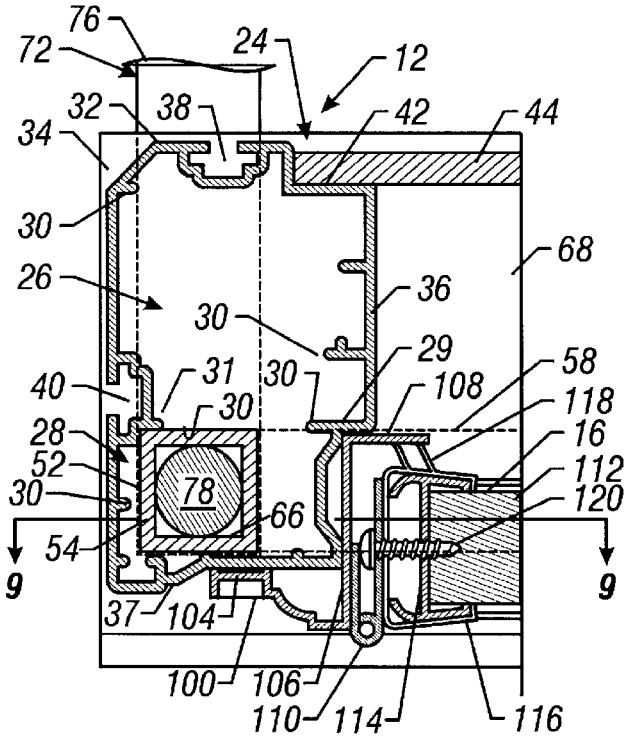
FIG. 8 is a sectional view taken along 8—8 of FIG. 3.

Each of the door displays 10 include top display frame member 20, and opposite side display frame members 22, 24. Each of the side display frame members in cross section includes a first tube 26 (FIG. 8) and a second tube 28 which are separated by a pair of oppositely inwardly extending spaced apart webs or walls 29, 31. A plurality of stand off ridges 30 extend inwardly into the first and second tubes 26, 28. Each extrusion includes a rear face 32, an outer face 34, an inner face 36, and a front face 37 which is preferably extruded into the shape of a conventional brick molding. Rear face 32 includes a vertical longitudinal screw slot 38 which is generally C-shaped in cross section. A similar C-shaped screw slot 40 is provided on the outer surface 34. The interior surface at the rear edge thereof includes U-shaped slot 42 which is fitted a rectangular panel 44. Panel 44 can be used to display point of sale printed matter for marketing the door in the display.

The two side members 22, 24 are joined at their upper ends with the top frame member 20 in a miter joint and are held in place by L-shaped brackets (not shown) which fit within the first tube 26 and which are secured in place by means of screws (not shown).

Figure 9:
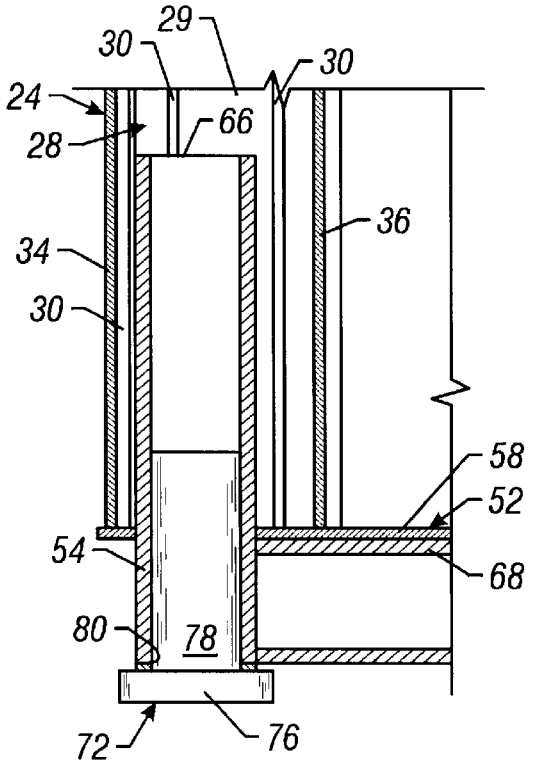
FIG. 9 is a sectional view taken along line 9—9 of FIG. 8.

Lower ends of side frame members 22, 24 are joined together by a U-shaped bottom frame 52 which is comprised of a pair of upstanding legs 54, 56 joined by a horizontal bar 58. The U-shaped frame member 52 may be formed by welding, bending, or by bolting the legs 54, 56 and horizontal bar 58 together. Other means for securing the components of the U-shaped frame together may be used without detracting from the invention. The lower ends of up standing legs 54 and 56 are tubular or hollow so as to provide a pivot hole 66 (FIGS. 8 and 9) for receiving a pivot pin 78. A threshold plate 68 includes notches 70 at its ends, and these notches 70 are sized to fit around the upstanding legs 54, 56 of U-shaped bottom frame 52. Up standing legs 54, 56 are force fitted into the second tube 28 of side frame members 22, 24 in the manner shown in FIG. 8 and are forced upwardly until the bar 58 presses the threshold plate 68 against the lower ends of side frame members 22, 24 in the manner shown in FIG. 3. If desired, screws may be used to secure the up standing legs 54, 56 within the side frame membres 22, 24.

Figure 3:
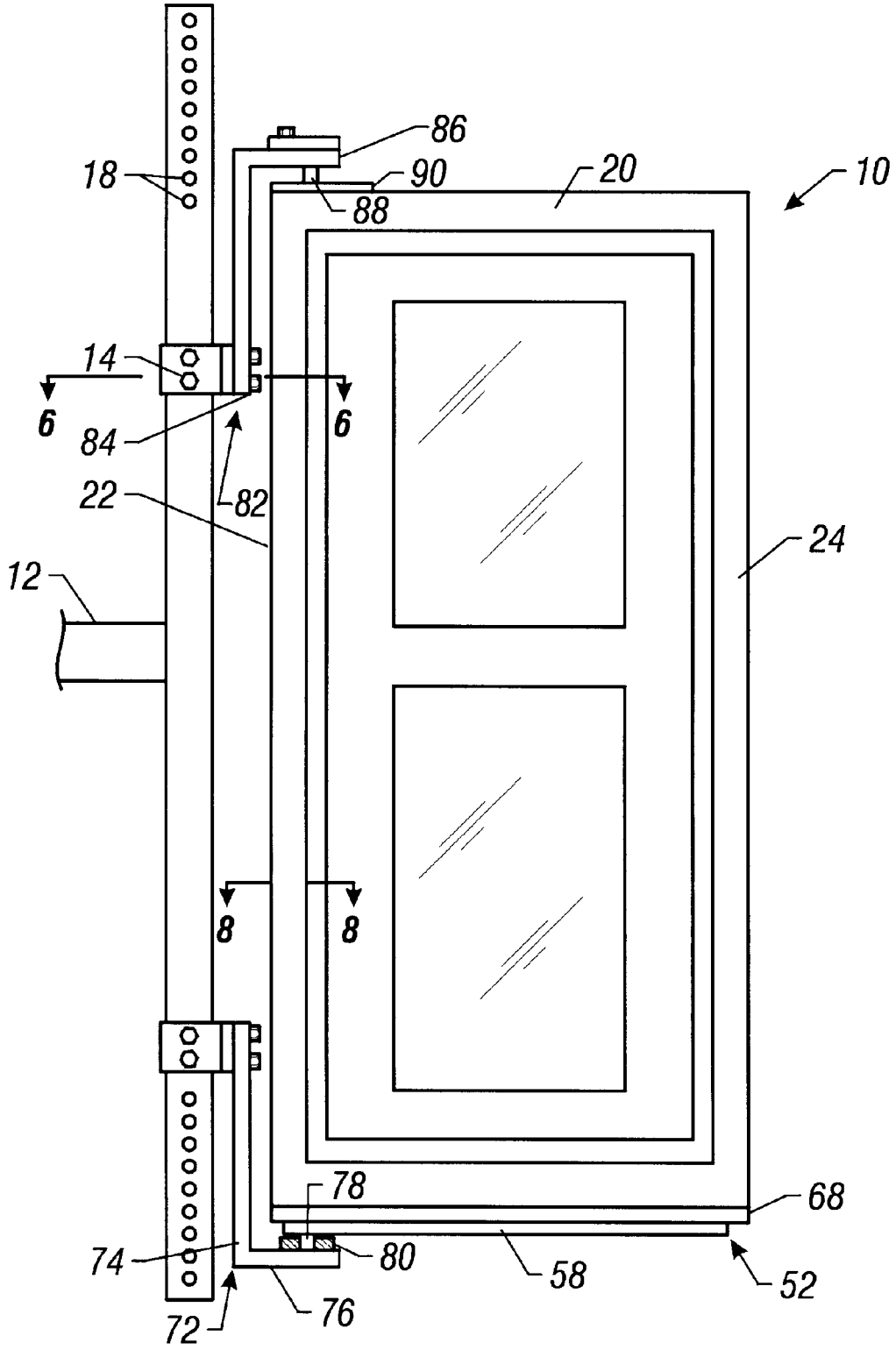
FIG. 3 is a side elevational view of the present invention, showing the display frame with a door mounted therein.

A bottom hinge bracket 72 includes a vertical leg 74 and a horizontal leg 76 (FIG. 3). Extending upwardly from horizontal leg 76 is hinge pin 78 having a bearing washer 80 connected thereto. The hinge pin 78 is fitted upwardly within the pivot hole 66 provided by the tubular construction of side frame member 54 in the manner shown in FIGS. 8 and 9.

Figure 4:
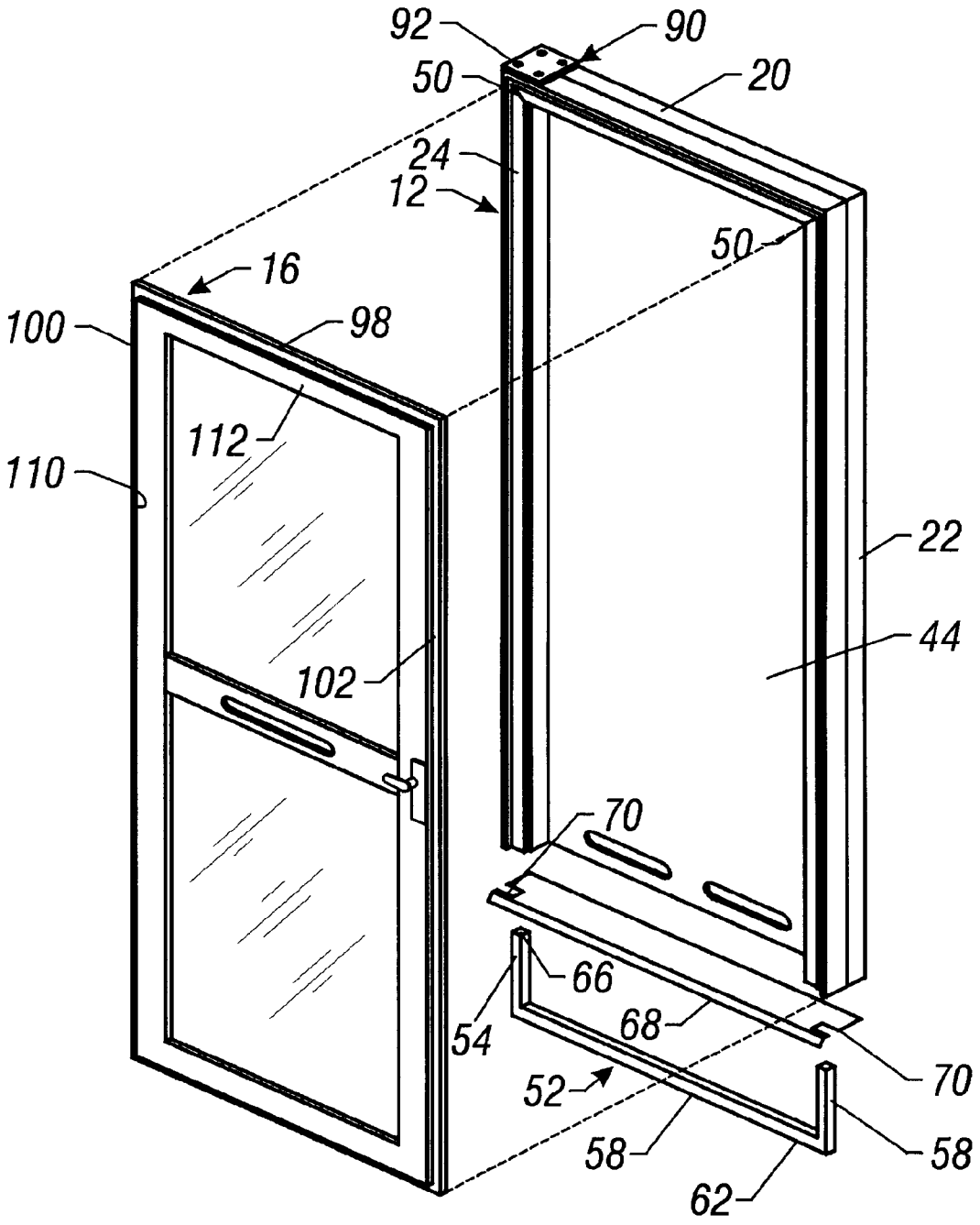
FIG. 4 is an exploded perspective view of the display frame and the door.

A top hinge member 82 (FIG. 3) includes a vertical leg 84 and a horizontal leg 86. Extending downwardly from horizontal leg 86 is a hinge pin 88 which extends through an upper hinge pin hole 92 in a reinforcing plate 90 (FIG. 4). A hinge pin hole (not shown) is provided in the upper frame member 20 and is registered with hole 92 in the reinforcing plate 90 for receiving the hinge pin 88.

Figure 6:
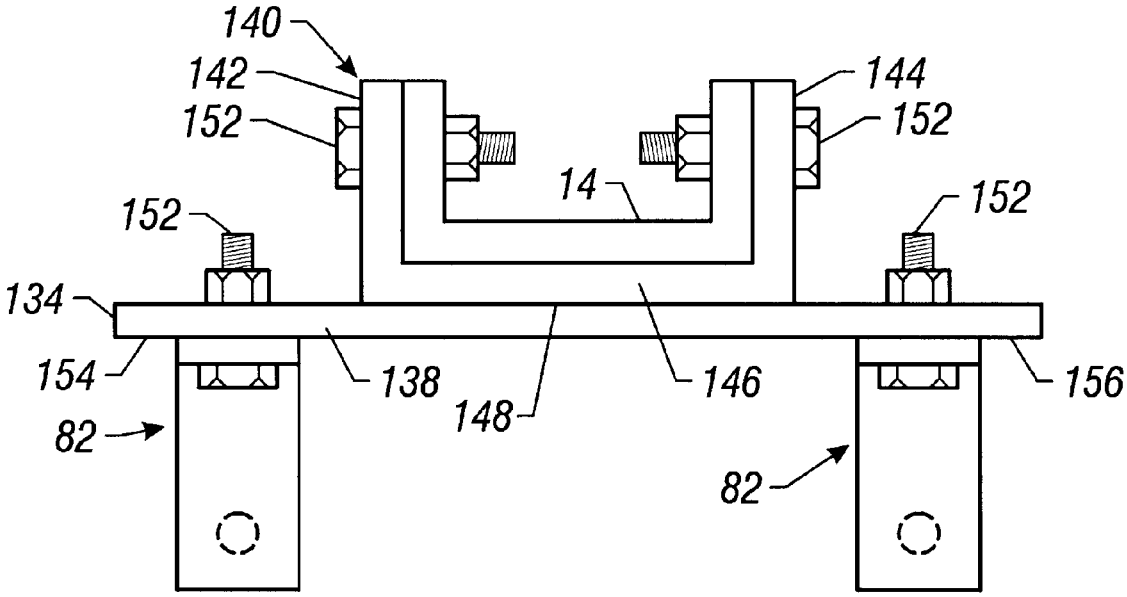
FIG. 6 is a sectional view taken along line 6—6 of FIG. 3.
Figure 7:
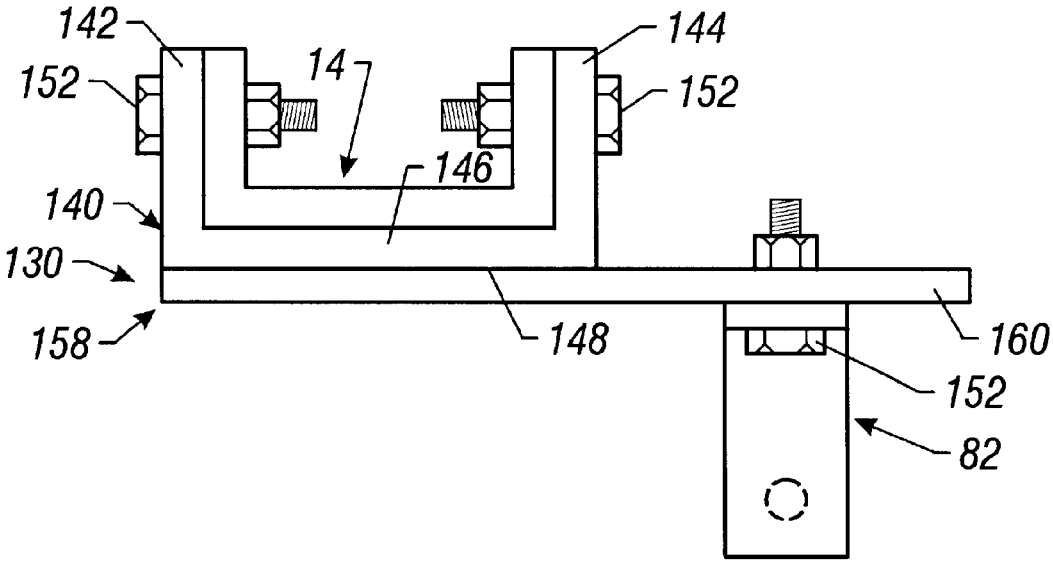
FIG. 7 is a view similar to FIG. 6 but showing a single wing form of the mounting bracket.

Referring to FIGS. 5, 6 and 7, the mounting system includes an upper single wing bracket 130, a lower single wing bracket 132, an upper double wing bracket 134 and a lower double wing bracket 136. The double wing brackets 134, 136 each comprise a double wing plate 138 and a U-shaped plate 140. The U-shaped plate includes spaced apart legs 142, 144 which are joined by a web 146. Legs 142, 144 and web 146 may be integrally formed or may be formed from three parts which are connected together by welding, bolting or other wise. The web 146 is attached to the rear surface of the double wing plate 38 by a weld 148, or by bolting or other securing means. The legs 142, 144 are provided with holes which will accommodate bolts 152 so as to permit the U-shaped plate 140 to be connected to the up standing vertical members 14 of the pallet rack frame. This is shown in FIGS. 6 and 7. Because the vertical members 14 include a plurality of spaced apart holes it is possible to position the brackets 130, 132, 134, 136 in a desired spaced apart relationship so as to permit the floor displays to be mounted. Upper and lower double wing brackets 134, 136 include mounting holes 150 in the double wing plate 138 so as to permit the L-shaped top hinge members 82 to be bolted in place as shown in FIGS. 5–7. Similarly the L-shaped bottom hinge members 72 may be bolted to the double wing plate 138 of floor double wing bracket 136. Each of the double wing plates 138 include a first wing 154 and a second wing 156 (FIG. 6). While the double wing plate 138 is shown to be planar, the bracket may be curved or otherwise configured to accommodate the various door displays in the desired manner.

In order to mount the display frames 10 vertically to the pallet rack, it is necessary to be able to move the brackets 134, 136 to the desired position on the vertical frame 14 so as to properly space the L-shaped hinge members 72, 82 for mounting to the door display. Horizontal members 16 of the pallet frame do not permit the U-shaped plates 40 to be moved to the proper position for mounting the display frames 10, and therefore the use of the L-shaped hinge members 72, 82 permits proper adjustment of the spacing between the upper and lower ends of the display frames 10.

Referring to FIG. 7 a single wing plate 130 is shown. In this configuration the U-shaped member 140 is positioned adjacent one side edge of the single wing plate 158 so as to create a single wing 160 protruding beyond the U-shaped bracket. As can be seen in FIG. 5 this configuration is useful for mounting a display frame to the end vertical frame member 14 of a pallet rack system.

The method of the present invention comprises attaching the upper and lower single wing brackets 130, 132 or the upper and lower double wing brackets 134, 136 to the vertical side bracket 114 by fitting the spaced apart legs 142, 144 around vertical support member 14 in the manner shown in FIGS. 6 and 7, embracing the vertical support member therebetween. The spaced apart legs are then attached to the vertical support member 14 with the upper and lower brackets 130, 132 or 134, 136 being in vertical spaced relation to one another. Then the upper and lower hinge members 72, 74 are mounted to the brackets and a door display frame 10 is connected between the upper and lower hinge members 72, 74. This permits door display frame 10 to pivot about a door display axis. A door frame is mounted within the door display frame and a door is mounted within the door frame for swinging movement about a door axis.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A door display device adapted to be mounted to a vertical support member having a front face, opposite side faces, and a rear face, said door display device comprising:

a display frame comprising a pair of spaced apart side display frame members, a top display frame member, and a bottom display frame member forming a display opening;

a door assembly comprising a door frame detachably mounted within said display opening, a door within said door frame, and a door hinge pivotally mounting said door to said door frame for swinging movement about a door axis;

an upper mounting bracket and a lower mounting bracket, each comprising a first plate and a U-shaped plate, said first plate having a front face and a rear face, said U-shaped plate having a pair of spaced apart legs joined by a central web, said central web being attached to said rear face of said first plate, said spaced apart legs being shaped to embrace said opposite side faces of said vertical support member therebetween;

an upper hinge member attached to said front face of said first plate of said upper mounting bracket;

a lower hinge member attached to said front face of said first plate of said lower mounting bracket;

said upper and lower hinge members pivotally connecting said display frame to said upper and lower mounting brackets respectively for permitting said display frame to swing about a display axis with respect to said upper and lower mounting brackets.

2. A door display device according to claim 1 wherein said first plate includes first and second wing portions which extend beyond said spaced apart legs of said U-shaped bracket.

3. A door display device according to claim 2 and comprising first and second upper hinge members connected to said first and second wing portions of said upper bracket, and first and second lower hinge members connected to said first and second wing portions of said lower bracket.

4. A door display device according to claim 3 and further comprising a second door display frame having a second door frame and a second door mounted therein, said first mentioned door display frame being connected to said first upper and lower hinge members for pivotal movement about a first door display axis, and said second door display being connected to said second upper and lower hinge members for pivotal movement about a second door display axis.

5. A door display device according to claim 1 wherein each of said first plates includes first and second opposite plate edges, said first plate edge being approximately registered with one of said legs of said U-shaped plate, said second plate edge extending laterally beyond the other of said legs of said U-shaped plate to create a wing portion of said first plate, said upper and lower hinge members being connected to said wing portions of said upper and lower brackets.

6. In combination:

a vertical support member having a front face, opposite side faces;

a display frame comprising a pair of spaced apart side display frame members, a top display frame member, and a bottom display frame member forming a display opening;

a door assembly comprising a door frame detachably mounted within said display opening, a door within said door frame, and a door hinge pivotally mounting said door to said door frame for swinging movement about a vertical door axis;

an upper mounting bracket and a lower mounting bracket, each comprising a first plate and a U-shaped plate, said first plate having a front face and a rear face, said U-shaped plate having a pair of spaced apart legs joined by a central web, said central web being attached to said rear face of said first plate, said spaced apart legs embracing and being attached to said opposite side faces of said vertical support member at spaced apart upper and lower locations respectively;

an upper hinge member attached to said front face of said first plate of said upper mounting bracket;

a lower hinge member attached to said front face of said first plate of said lower mounting bracket;

said upper and lower hinge members pivotally connecting said display frame to said upper and lower mounting brackets respectively for permitting said display frame to swing about a vertical axis with respect to said upper and lower mounting brackets.

7. A door display device according to claim 6 wherein said vertical support member comprises a front vertical frame member of a pallet rack having storage shelves extending rearwardly therefrom.

8. A mounting bracket system for mounting a door display device to a vertical support member, said door display device having a door display frame forming a display opening, a door frame being detachably mounted within said display opening, and a door being mounted to said door frame for swinging movement about a door axis; said mounting bracket system comprising:

an upper mounting bracket and a lower mounting bracket, each of which comprise a first plate having a front plate face and a rear plate face and a U-shaped plate having a pair of legs joined by a web member, said web member being attached to said rear face of said first plate, said legs being spaced apart a distance that permits said pair of legs to embrace and be detachably secured to said vertical support member therebetween;

a first hinge member and a second hinge member being connected to said upper and lower mounting brackets, respectively, and to said door display frame for permitting said door display to pivot about a door display axis with respect to said upper and lower mounting brackets.

9. A method for attaching a door display device to a vertical support member comprising:

taking an upper and a lower bracket, each of which comprise a first plate having a front plate face and a rear plate face and a U-shaped plate having a pair of legs joined by a web member, said web member being attached to said rear face of said first plate;

fitting said spaced apart legs of said upper and lower brackets around said vertical support member so as to embrace said vertical support member therebetween;

attaching said spaced apart legs of said upper and lower brackets to said vertical support member in vertical spaced relation to one another;

attaching upper and lower hinge members to said front plate faces of said upper and lower brackets, respectively;

connecting a door display frame to said upper and lower hinge members for pivotal movement about a door display axis;

mounting a door frame within said door display frame, said door frame having a door mounted therein for swinging movement about a door axis.

* * * * *